US006068523A

United States Patent [19]

Takahashi

[11] Patent Number: 6,068,523

[45] Date of Patent: May 30, 2000

[54] CIRCUIT MOLDED STRUCTURE HAVING BUS BARS FORMING INTERNAL CIRCUITS

[75] Inventor: Toshiharu Takahashi, Shizuoka, Japan

[73] Assignee: Yazaki Corporation, Tokyo, Japan

[21] Appl. No.: 09/287,414

[22] Filed: Apr. 7, 1999

[30] Foreign Application Priority Data

Apr. 10, 1998 [JP] Japan ..... 10-099564

[51] Int. Cl.[7] ..... H01R 13/405

[52] U.S. Cl. ..... 439/736; 439/736; 439/752; 439/604; 439/605; 439/606

[58] Field of Search ..... 439/736, 752, 439/604, 605, 606

[56] References Cited

U.S. PATENT DOCUMENTS

| | | | |
|---|---|---|---|
| 4,684,202 | 8/1987 | House et al. | 439/752 |
| 5,120,268 | 6/1992 | Gerrans | 439/736 |
| 5,273,819 | 12/1993 | Jex | 428/297 |

*Primary Examiner*—Paula Bradley
*Assistant Examiner*—Truc Nguyen
*Attorney, Agent, or Firm*—Sughrue, Mion, Zinn, Macpeak & Seas, PLLC

[57] ABSTRACT

A circuit molded structure in which a crack is prevented from developing when a secondary molded member is integrally molded on a primary molded member having bus bars. The circuit molded structure includes the primary molded member (40) having a plurality of bus bars (42) insert-molded therein, and the secondary molded member (30) formed integrally on the primary molded member (40) by secondarily molding a resin on those portions of the primary molded member (40) other than terminal portions of the bus bars (42), the plurality of bus bars (42) forming internal circuits. Bent portions (45) of the bus bars (42) are exposed, and the secondary molding is effected with the exposed bent portions (45) covered with a resin spacer (47). As a result of the provision of the resin spacer (47), the resin will not flow to the bent portions, and the thickness becomes uniform, and any crack due to expansion and shrinkage will not occur.

9 Claims, 8 Drawing Sheets

CIRCUIT MOLDED STRUCTURE HAVING BUS BARS FORMING INTERNAL CIRCUITS

BACKGROUND OF THE INVENTION

1. Field of the Invention

The present invention relates to a circuit molded structure having bus bars forming internal circuits.

The present application is based on Japanese Patent Application No. Hei. 10-99564, which is incorporated herein by reference.

2. Description of the Related Art

A circuit molded structure, having bus bars serving as internal circuits, has been used in an electric part such as a connector. For molding the circuit molded structure, a plurality of bus bars are inserted in a mold, and in this condition, a resin is molded to form a primary molded member or body holding the plurality of bus bars in non-contact relation to one another, and then a resin is secondarily molded on the primary molded body, thereby forming the circuit molded structure.

FIG. 5 shows a primary molded member 1 having a plurality of bus bars 2 insert-molded therein. In order that terminal portions 2*a* of the bus bars 2 may be arranged at a predetermined pitch and that the secondary molding operation may be effected easily, each bus bar 2 has an L-shaped bent portion 5. In the primary molded member 1, generally the whole of each bus bar 2 except the terminal portion 2*a* is held by a hold portion 3. Therefore, the resin is molded also on the bent portion 5 of the bus bar 2.

In the primary molded member 1 thus formed, however, the bus bar 2 is liable to tilt inwardly as at A (see FIG. 6) at one side of the bent portion 5 when the resin, forming the hold portion 3, shrinks. Even if the primary molded member 1, subjected to such inward tilt A, is set in a mold 4 for effecting the secondary molding, the primary molded member 1 interferes with the mold 4 at a portion indicated by B in FIG. 7. Therefore, there has been a possibility that the secondary molding is not be properly carried out.

Accordingly, there has heretofore been used the type of primary molded member in which the bent portions 5 of the bus bars 2 are not covered with the resin. FIG. 8 shows such a improved primary molded member 6 in which a hold portion 3 is divided into a hold section 3*a* and a hold section 3*b* provided respectively on opposite sides of a bent portion 5 of each bus bar 2, and the bent portion 5 is not covered with the resin, and therefore is exposed. With this construction, the inward tilting of the bus bars 2 due to shrinkage of the resin is prevented.

In FIGS. 9 to 12, a resin is secondarily molded on the improved primary molded member 6, thereby integrally forming a secondary molded member 7 on the primary molded member 6, thus forming a circuit molded structure 8 such as a connector-incorporating case. As shown in FIGS. 9 and 11, the primary molded member 6 has a construction in which the bent portions 5 of the bus bars 2 are not covered with the resin, and this primary molded member 6 is set in a mold (not shown) for effecting the secondary molding, and the resin is secondarily molded. As a result, as shown in FIGS. 10 and 12, there is formed the circuit molded structure 8 in which the secondary molded member 7, having a board mounting portion 9 and a connector portion 10 disposed perpendicular to the board mounting portion 9, is integrally molded on the primary molded member 6.

In this circuit molded structure 8, the board mounting portion 9 and the connector portion 10 of the secondary molded member 7 are disposed perpendicular to each other through an interconnecting portion 11. A printed circuit board (not shown) is mounted on the board mounting portion 9, and a mating connector (not shown) is fitted into the connector portion 10 so as to make an electrical connection. Each bus bar 2 of the primary molded member 6 is provided in the board mounting portion 9 and the connector portion 10, and the bent portion 5 of the bus bar 2 is disposed in the interconnecting portion 11 of the secondary molded member 7.

However, in the circuit molded structure 8, the bent portions 5 of the bus bars 2 are exposed, and the resin is liable to flow to the bent portions 5 during the secondary molding, and as a result that portion (indicated by C in FIG. 10) of the interconnecting portion 11 of the secondary molded member 7, corresponding to the bent portions 5, becomes greater in thickness than the remainder of the interconnecting portion 11, so that the thickness difference develops between these portions. If such thickness difference is encountered, there develops a time lag in expansion and shrinkage of the resin between these portions, so that internal stresses increase, and therefore a thermal shock resistance is lowered. As a result, cracks 12 develop in the interconnecting portion 11.

And besides, during the secondary molding, the bent portions 5 of the multi-pole bus bars 2 are disposed at the interconnecting portion 11 in an exposed manner, and heat, developing during the secondary molding, is transferred to the hold portions 3*a* and 3*b* of the primary molded member 6 through the exposed bent portions 5, and resides in these hold portions 3*a* and 3*b*. Therefore, those portions of the molded structure, having the hold portions 3*a* and 3*b* of the primary molded member 6, and that portion (corresponding to the bent portions 5), having only the resin of the secondary molding, are different in contraction coefficient (shrinkage factor) from each other. Therefore, the above-mentioned cracks 12 are more liable to develop.

In the case where each of the primary molded member 6 and the secondary molded member 7 is molded of a resin containing glass fibers, the orientations of the glass fibers are different from one portion to another depending on the specification of the molded product. More specifically, if the glass fibers of the hold portion 3*b* of the primary molded member 6 are oriented in a direction 13 (see FIG. 11), the glass fibers of the interconnecting portion 11 of the secondary molded member 7, corresponding to the hold portion 3*b*, are oriented in a direction 14 (see FIG. 12). Thus, the orientation directions 13 and 14 are different from each other. If the orientation directions of the glass fibers of the two portions are thus different from each other, these portions of the molded product are different in contraction coefficient from each other, and therefore cracks due to a thermal shock develop in these portions.

SUMMARY OF THE INVENTION

It is therefore an object of the present invention to provide a circuit molded structure in which even if bent portions of bus bars are exposed, any crack will not develop in a molded resin.

To achieve the above object, according to the first aspect of the present invention, there is provided a circuit molded structure which comprises a primary molded member including a plurality of bus bars insert-molded therein, the plurality of bus bars having terminal portions and exposed portions which are exposed from the primary molded member, a resin spacer attached to the exposed portions to cover them, and a secondary molded member molded integrally on the primary molded member so as to cover the resin spacer. The bus bars may form internal circuits. Preferably, the secondary molded member is molded integrally on portions of the primary molded member other than the terminal portions of the bus bars. In this structure, even though the bus bars have the exposed portions, respectively, the secondary molding is effected, with the exposed portions covered with the resin spacer, and therefore the resin will not flow to the exposed portions during the secondary molding. Therefore, the thickness difference will not develop in the secondary molded member, and a thermal shock resistance will not be lowered by the thickness difference, and therefore cracks will not develop.

According to the second aspect of the present invention, preferably, the bus bars are respectively bent to form bent portions, and the exposed portions of the bus bars are provided at the bent portions of the bus bars, respectively. In this structure, the bent portions of the bus bars are the exposed portions, respectively, and the bent portions are not covered with the resin, and therefore even if the resin shrinks, the primary molded member will not be subjected to inward tilting due to such shrinkage. Since the bent portions are exposed, a spring force is imparted to the bus bars. With this construction, the primary molded member can be positively set in a mold.

According to the third aspect of the present invention, preferably, the primary molded member and the secondary molded member are formed of a resin containing glass fibers, and wherein a direction of orientation of the glass fibers in the primary molded member is the same as a direction of orientation of the glass fibers in the secondary molded member. In this structure, even though each of the primary molded member and the secondary molded member is molded of the resin containing the glass fibers, the directions of orientation of the glass fibers in the two molded members are the same, and therefore the two molded members after the molding are equal in contraction coefficient (shrinkage factor) to each other. Therefore, any crack due to a thermal shock will not develop.

DETAILED DESCRIPTION OF THE PREFERRED EMBODIMENT

Figure 1:
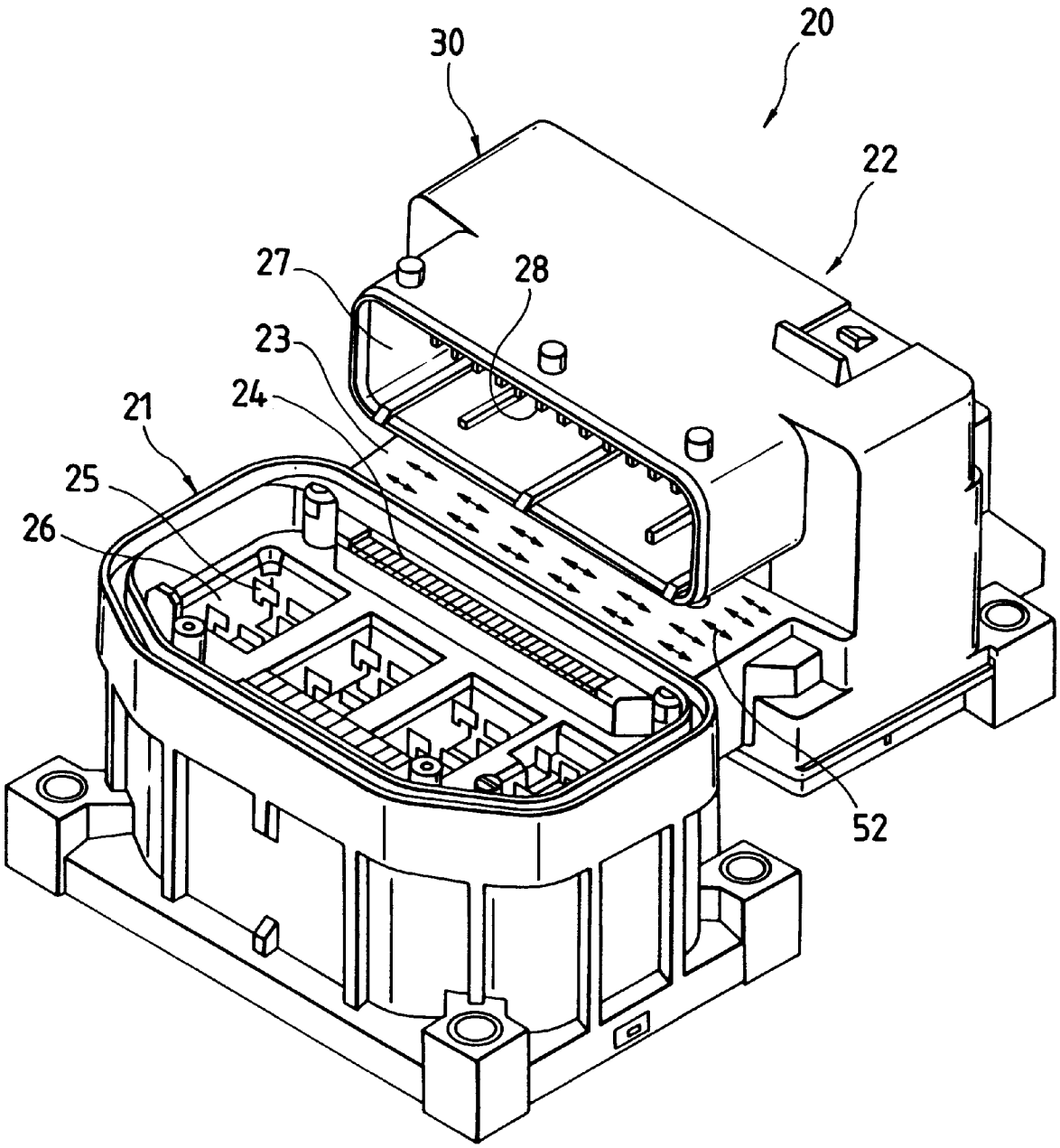
FIG. 1 is a perspective view of one preferred embodiment of a connector-incorporating case of the present invention showing a circuit molded structure.
Figure 2:
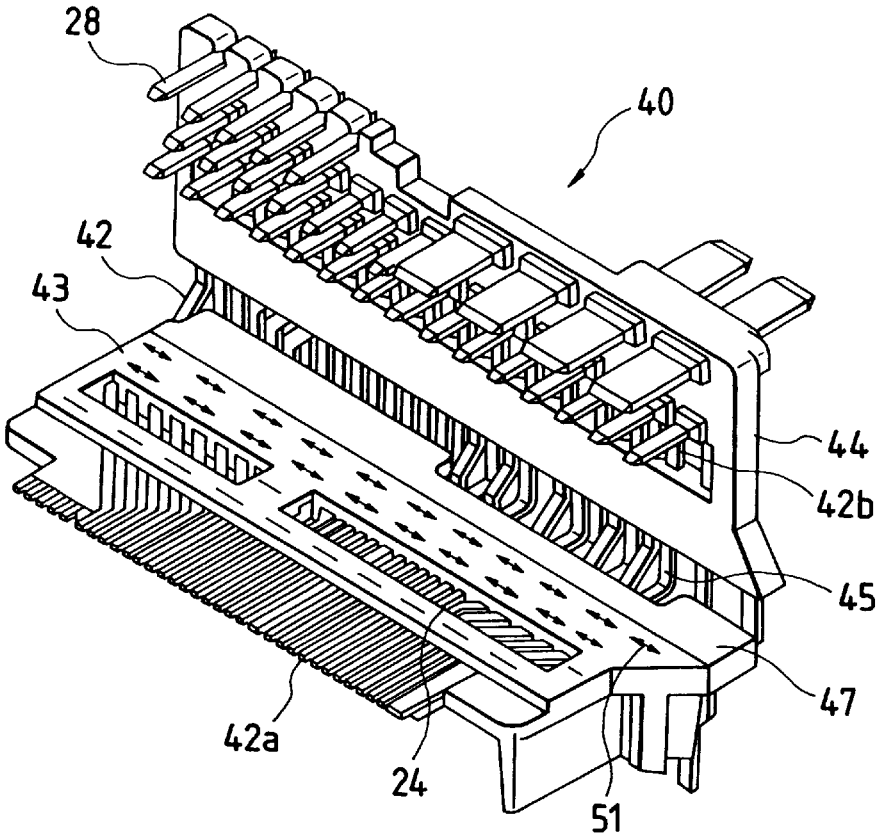
FIG. 2 is a perspective view of a primary molded member of the connector-incorporating case of FIG. 1.
Figure 3:
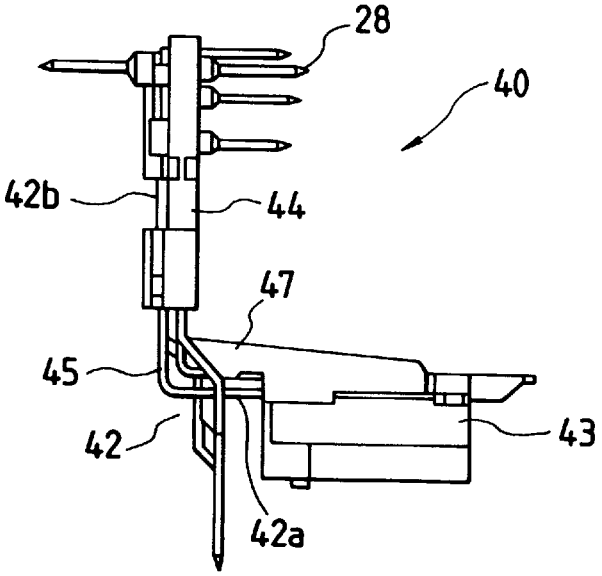
FIG. 3 is a side-elevational view of the primary molded member of FIG. 2.
Figure 4:
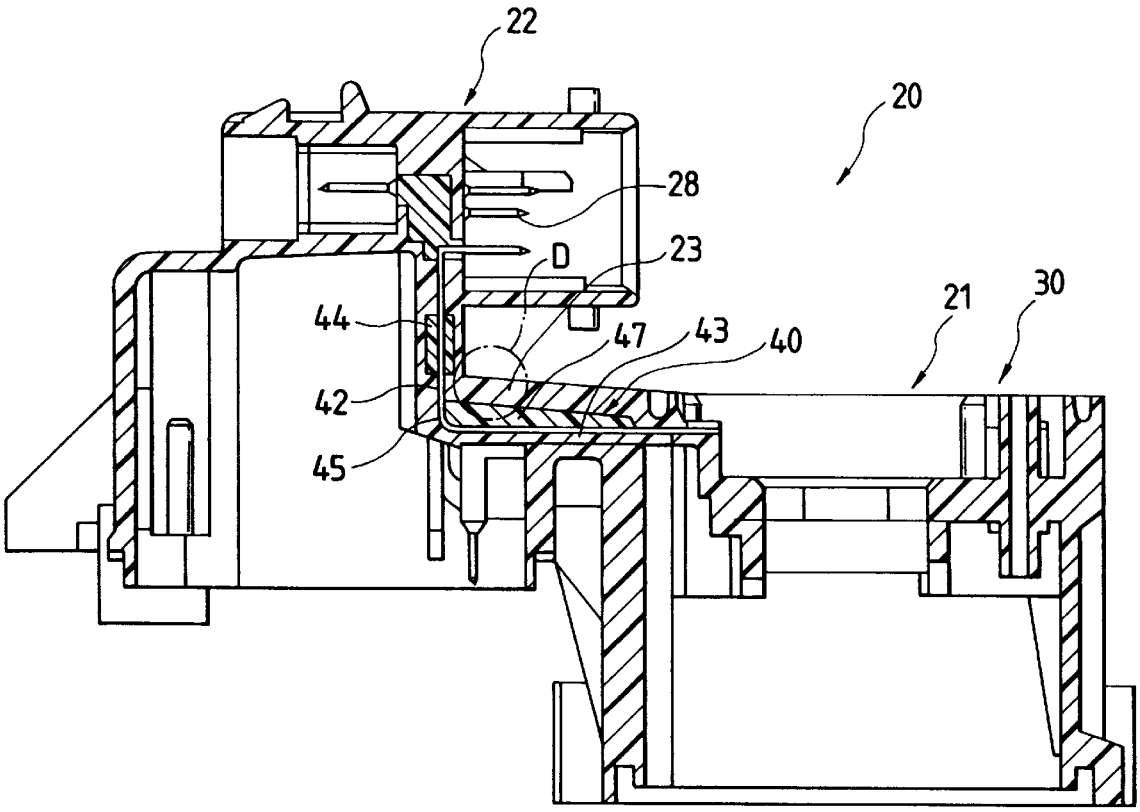
FIG. 4 is a cross-sectional view of the connector-incorporating case.
Figure 5:
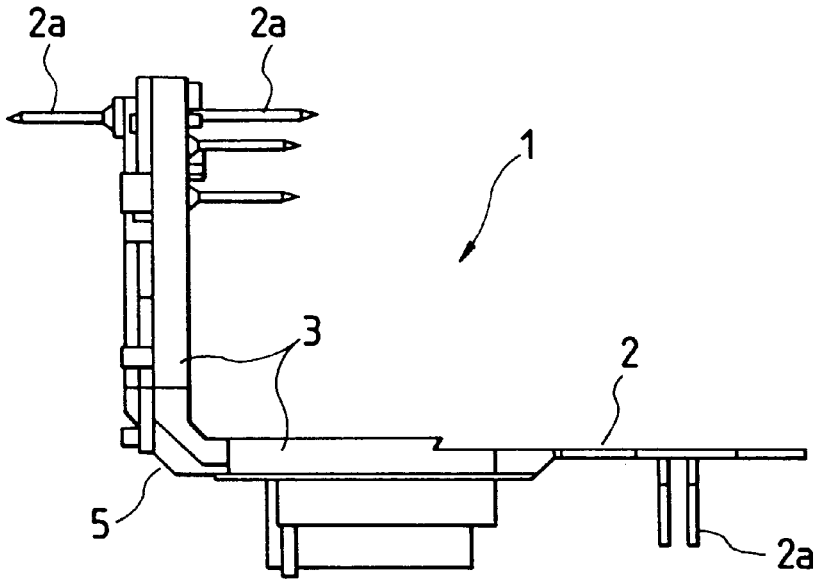
FIG. 5 PRIOR ART
FIG. 5 is a side-elevational view of the related primary molded member.
Figure 6:
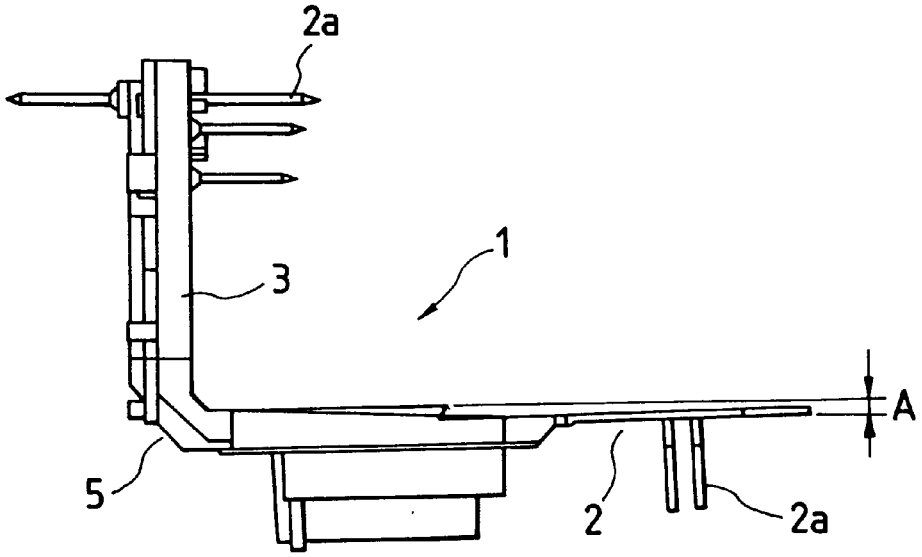
FIG. 6 PRIOR ART
FIG. 6 is a side-elevational view showing the related primary molded member subjected to inward tilting.
Figure 7:
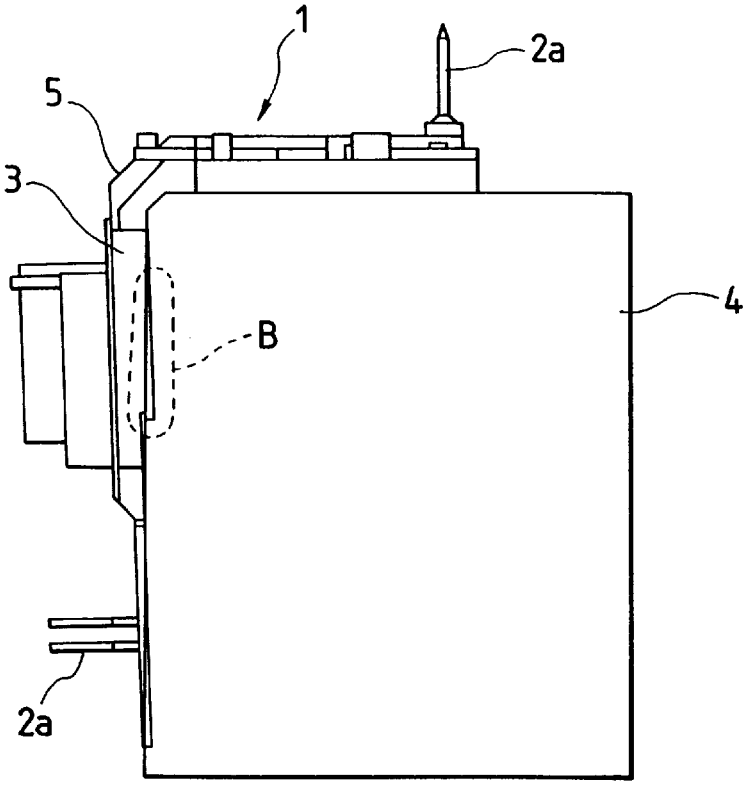
FIG. 7 PRIOR ART
FIG. 7 is a side-elevational view showing the inwardly-tilted primary molded member set in a mold.
Figure 8:
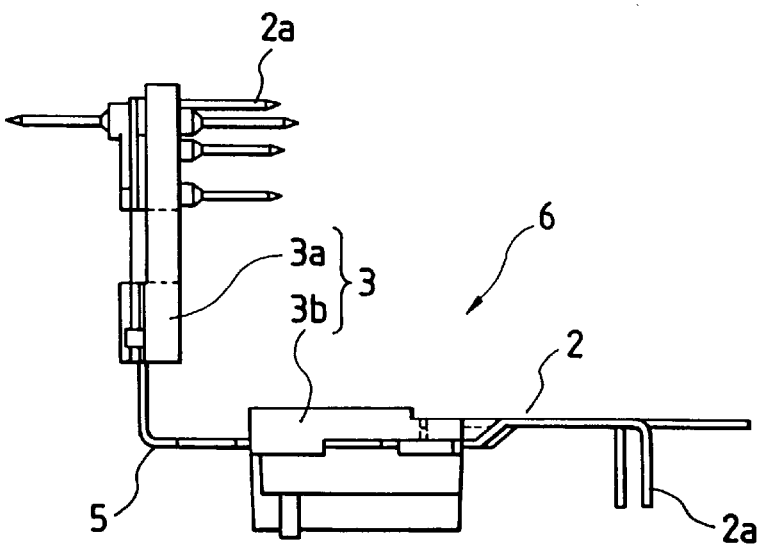
FIG. 8 is a side-elevational view of the related primary molded member of the improved type.
Figure 9:
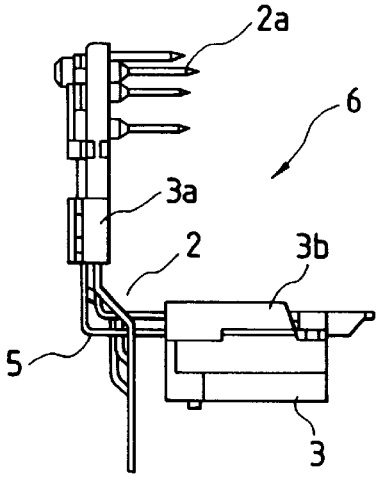
FIG. 9 is a side-elevational view of the primary molded member used in the related circuit molded structure.
Figure 10:
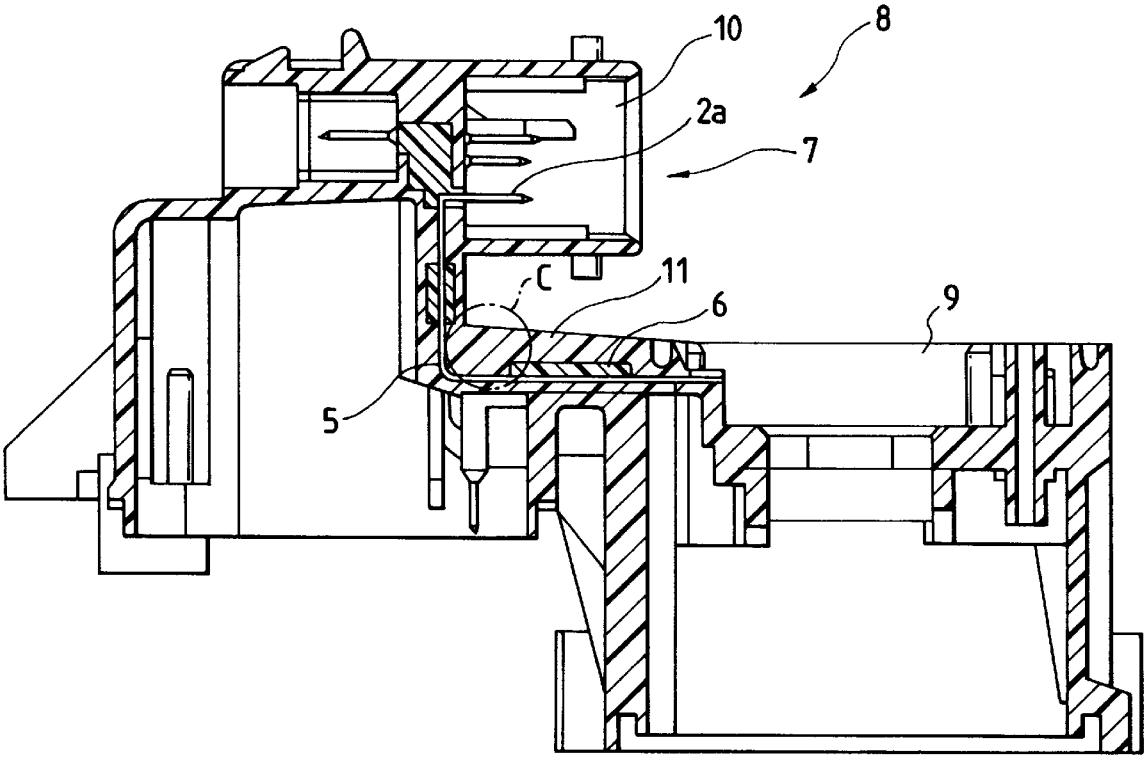
FIG. 10 is a cross-sectional view of the related circuit molded structure.
Figure 11:
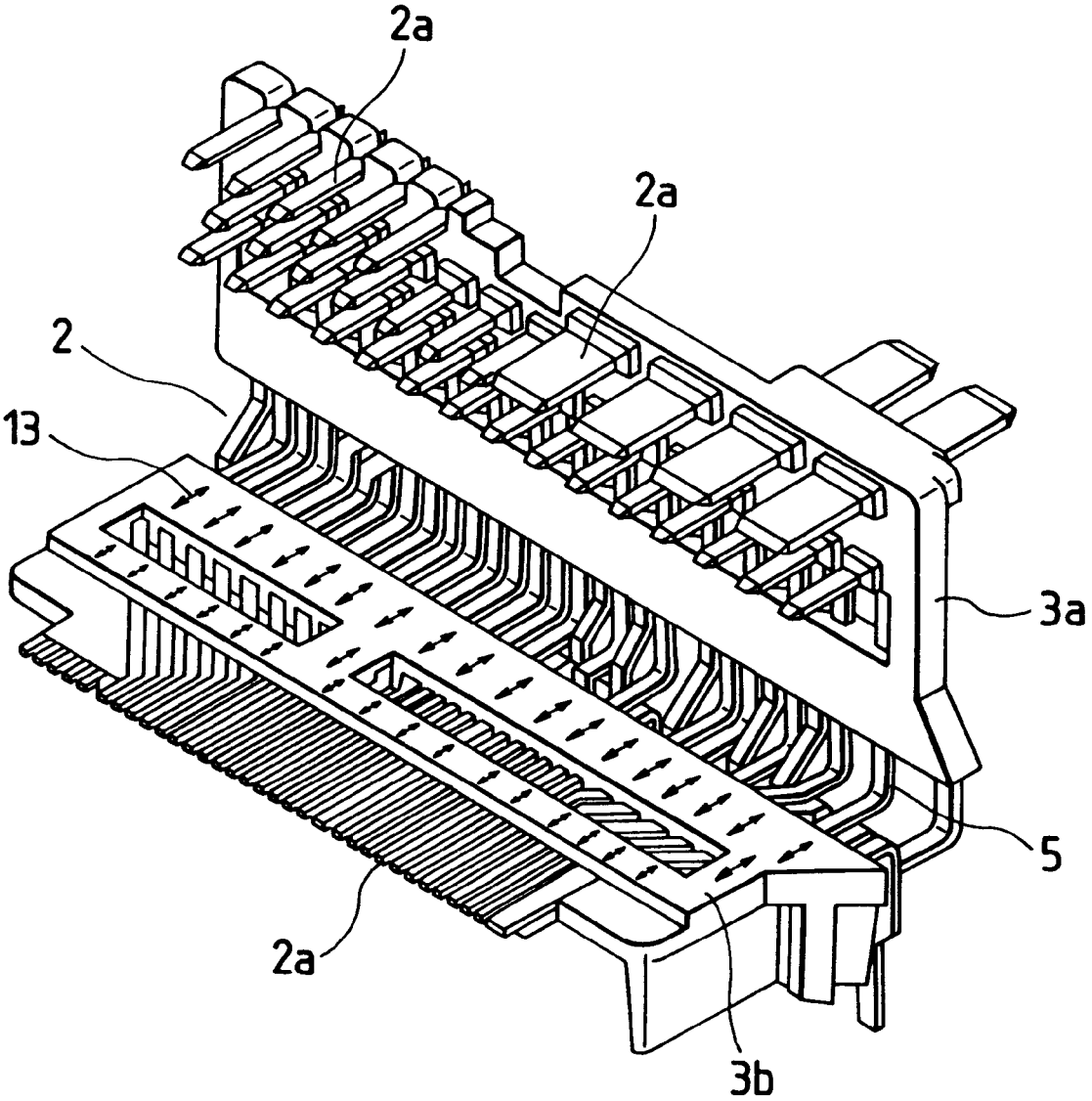
FIG. 11 is a perspective view of the primary molded member used in the related circuit molded structure, showing the direction of orientation of glass fibers in the primary molded member.
Figure 12:
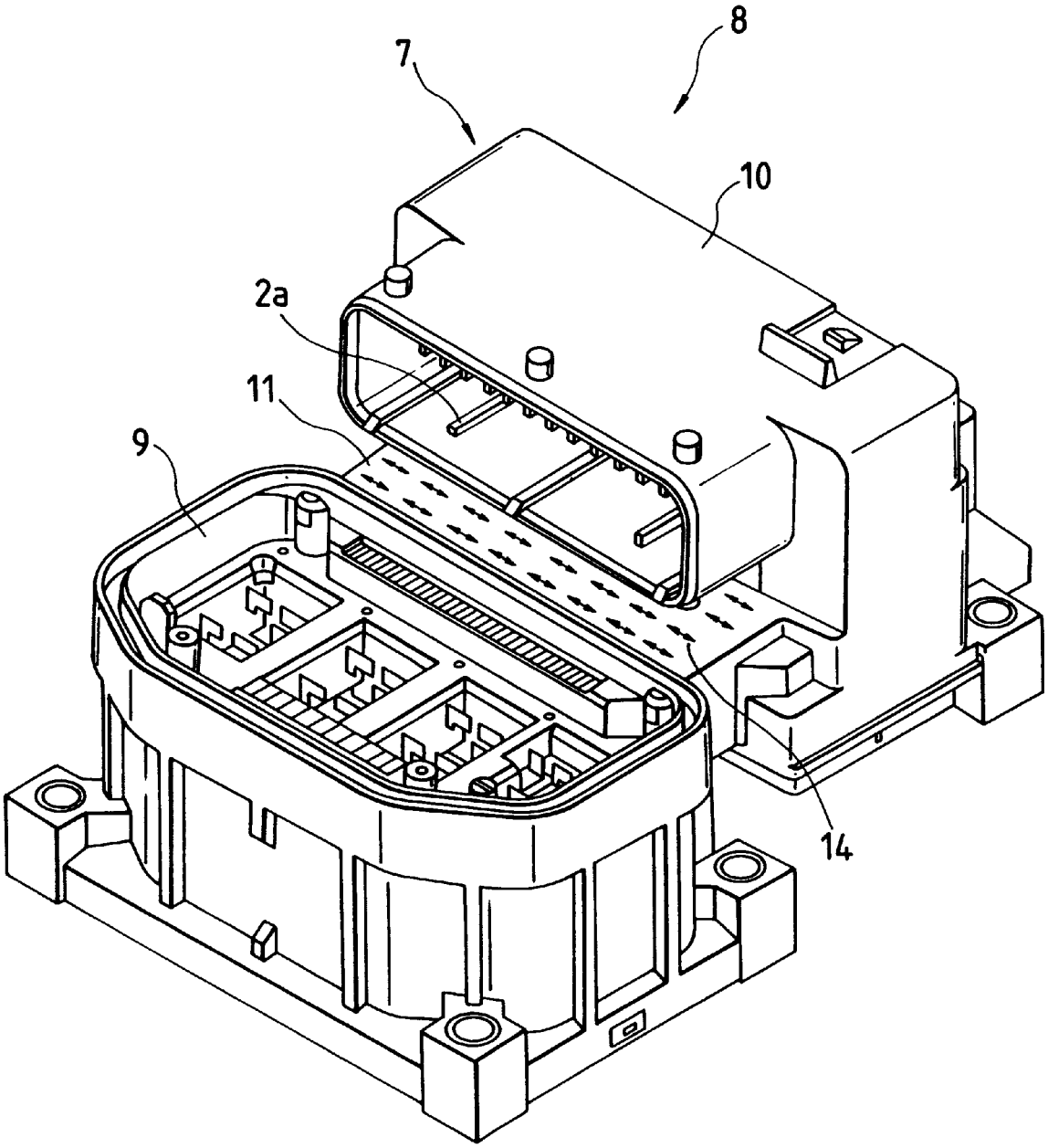
FIG. 12 is a perspective view of the related circuit molded structure, showing the direction of glass fibers therein.

FIGS. 1 to 4 show one preferred embodiment of the present invention, and FIGS. 1 and 4 show a connector-incorporating case (circuit molded structure) 20, and FIGS. 2 and 3 show a primary molded member 40.

The connector-incorporating case (circuit molded structure) 20 includes a board mounting portion 21 and a connector portion 22 which are interconnected in perpendicular relation to each other by an interconnecting portion 23. The board mounting portion 21 has an open top, and a board (not shown) such as a printed circuit board is mounted in this open top portion from the upper side. Exposed terminals 24 of bus bars 42, exposed in a row, are provided in the board mounting portion 21, and these exposed terminals 24 are connected to patterns of the board by wire bonding (not shown). A plurality of recesses 26 each having projected terminals 25 are formed in the board mounting portion 21.

The connector portion 22 is integrally formed on the rear side of the board mounting portion 21 through the interconnecting portion 23. The connector portion 22 has a connector insertion hole 27 for receiving a mating connector (not shown), and this connector insertion hole 27 is open to that side where the board mounting portion 21 is provided. Contact terminals 28 for being contacted respectively with terminals of the mating connector are provided within the connector insertion hole 27. These contact terminals 28, as well as the exposed terminals 24, are parts or portions of the bus bars 42, respectively.

For forming the connector-incorporated case 20, the primary molded member 40, holding the bus bars 42, is set in a mold, and then a resin is secondarily molded on the primary molded member 40, thereby forming a secondary molded member 30 (having the board mounting portion 21, the connector portion 22, and the interconnecting portion 23) integrally on the primary molded member 40.

As shown in FIGS. 2 and 3, the primary molded member 40 includes the plurality of bus bars 42 for multi-pole purposes, and hold portions 43 and 44 which hold the plurality of bus bars 42 in non-contact relation to one another. The bus bar 42 has an L-shaped bent portion 45 intermediate opposite ends thereof, and an upper end portion of a vertical portion 42*b*, extending upwardly from the bent portion 45, is further bent to form the contact portion 28. A horizontal portion 42*a*, extending horizontally from the bent portion 45, has the exposed terminal 24. These bus bars 42 form internal circuits of the connector-incorporating case 20.

The bus bars 42 are inserted in a mold, and in this condition a resin is poured into this mold to mold the hold portions 43 and 44. The hold portion 43 holds the horizontal portions 42*a* of the bus bars 42, and the hold portion 44 holds the vertical portions 42*b* of the bus bars 42. The bent portion 45 of each bus bar 42 is not covered with the resin, but is exposed. Each bent portion 45 is thus exposed, and with this construction, when the resin of the hold portions 43 and 44 shrinks, the primary molded member 40 will not be subjected to inward tilting which would otherwise occur in accordance with the shrinkage of the resin, and besides a spring force can be imparted to the bus bar 42. Therefore, for effecting the secondary molding, the primary molded member 40 can be positively set in a mold.

When the secondary molding is to be effected for the primary molded member 40, a resin spacer 47 is placed on the exposed bent portions 45. The thus placed resin spacer 47 covers the bent portions (exposed portions) 45 of the bus bars 42, and the primary molded member 40 is set in the mold for the secondary molding, with the bent portions 45 covered with the resin spacer 47. Then, the mold is clamped, and a molten resin is supplied into the mold so as to effect the secondary molding, thereby integrally forming the secondary molded member 30 on the primary molded member 40. As a result of this molding operation, the interconnecting portion 23 of the secondary molded member 30 is formed at that region corresponding to the resin spacer 47 and the hold portion 43 (see FIG. 4).

In this molding operation, the exposed bent portions 45 of the bus bars 42 are covered with the resin spacer 47, and therefore the resin will not flow to the bent portions 45 during the secondary molding. Therefore, that portion (indicated by D in FIG. 4) of the interconnecting portion 23 of the secondary molded member 30, corresponding to the resin spacer 47, is equal in thickness to the remainder of this interconnecting portion 23, and therefore any thickness difference will not develop. Therefore, there will not be encountered a time lag in expansion and shrinkage of the resin, so that internal stresses decrease, and as a result, the thermal shock resistance is increased, so that any crack will not develop.

In this embodiment, each of the primary molded member 40 and the secondary molded member 30 can be molded of a resin containing glass fibers. In this case, the direction of orientation of the glass fibers in the primary molded member 40 is the same as the direction of orientation of the glass fibers in the secondary molded member 30.

More specifically, if the glass fibers in the primary molded member 40 are oriented in a direction 51 (see FIG. 2), the glass fibers in the secondary molded member 30 are oriented in a direction 52 (see FIG. 1) which is the same as the orientation direction 51. In order that the direction of orientation of the glass fibers in the primary molded member 40 may thus be the same as the direction of orientation of the glass fibers in the secondary molded member 30, a gate for supplying the resin during the primary molding and a gate for supplying the resin during the secondary molding are arranged in the same direction.

Thus, the direction of orientation of the glass fibers in the primary molded member 40 is the same as the direction of orientation of the glass fibers in the secondary molded member 30, and with this construction the two molded members after the molding are equal in contraction coefficient (shrinkage factor) to each other. Therefore, internal stresses will not develop during the shrinkage, and any crack due to a thermal shock will not develop.

According to the present invention, the secondary molding is effected, with the exposed portions of the bus bars covered with the resin spacer, and therefore the resin will not flow to the exposed portions during the secondary molding, and the thickness difference will not develop in the secondary molded member. Therefore, any crack due to the thickness difference will not develop.

According to the present invention, the bent portions of the bus bars, which are the exposed portions, are not covered with the resin, and therefore the primary molded member will not be subjected to inward tilting, and the primary molded member can be positively set in a mold.

According to the present invention, the directions of orientation of the glass fibers in the two molded members are the same, and therefore the two molded members after the molding are equal in contraction coefficient (shrinkage factor) to each other, and any crack due to a thermal shock will not develop.

What is claimed is:

1. A circuit molded structure, comprising:

a primary molded member including a plurality of bus bars insert-molded therein, said plurality of bus bars having terminal portions and exposed portions which are exposed from said primary molded member;

a resin spacer attached to said exposed portions of said bus bars to cover said exposed portions; and a secondary molded member molded integrally on said primary molded member to cover said resin spacer, wherein said secondary molded member completely covers said resin spacer.

2. The circuit molded structure of claim 1, wherein said bus bars are respectively bent to form bent portions, and wherein said exposed portions of said bus bars are provided at said bent portions of said bus bars, respectively.

3. The circuit molded structure of claim 1, wherein said primary molded member and said secondary molded member are formed of a resin containing glass fibers, and wherein a direction of orientation of said glass fibers in said primary molded member is the same as a direction of orientation of said glass fibers in said secondary molded member.

4. The circuit molded structure of claim 2, wherein said primary molded member and said secondary molded member are formed of a resin containing glass fibers, and wherein a direction of orientation of said glass fibers in said primary molded member is the same as a direction of orientation of said glass fibers in said secondary molded member.

5. The circuit molded structure of claim 1, wherein said bus bars form internal circuits.

6. The circuit molded structure of claim 1, wherein said secondary molded member is molded integrally on portions of said primary molded member other than said terminal portions of said bus bars.

7. The circuit molded structure of claim 1, wherein said secondary molded member comprises:

a first connecting portion covering said exposed terminals of said bus bars; and a second connecting portion integrally formed on a rear side of said first connecting portion covering said terminal portions of said bus bars;

wherein said first connecting portion and said second connecting portion are interconnected in perpendicular relation to each other by an interconnecting portion.

8. The circuit molded structure of claim 7, wherein said first connecting portion is a board mounting portion.

9. The circuit molded structure of claim 7, wherein said second connecting portion is a connector portion.

* * * * *